US010472891B2

(12) United States Patent
Zhu et al.

(10) Patent No.: US 10,472,891 B2
(45) Date of Patent: Nov. 12, 2019

(54) HYDRAULIC GENTLE VIBRATION SPEED-ENHANCING DRILLING TOOL

(71) Applicant: Southwest Petroleum University, Chengdu, Sichuan (CN)

(72) Inventors: Xiaohua Zhu, Sichuan (CN); Jun Jing, Sichuan (CN)

(73) Assignee: Southwest Petroleum University, Chengdu, Sichuan (CN)

( * ) Notice: Subject to any disclaimer, the term of this patent is extended or adjusted under 35 U.S.C. 154(b) by 108 days.

(21) Appl. No.: 15/556,463

(22) PCT Filed: Jul. 7, 2016

(86) PCT No.: PCT/CN2016/089004
§ 371 (c)(1),
(2) Date: Sep. 7, 2017

(87) PCT Pub. No.: WO2017/005197
PCT Pub. Date: Jan. 12, 2017

(65) Prior Publication Data

US 2018/0051516 A1 Feb. 22, 2018

(30) Foreign Application Priority Data

Jul. 9, 2015 (CN) ..... 2015 1 0397029

(51) Int. Cl.
*E21B 4/02* (2006.01)
*E21B 7/24* (2006.01)
(Continued)

(52) U.S. Cl.
CPC ..... *E21B 4/02* (2013.01); *E21B 4/003* (2013.01); *E21B 7/24* (2013.01); *E21B 28/00* (2013.01); *E21B 34/06* (2013.01)

(58) Field of Classification Search
CPC ..... E21B 7/24; E21B 4/02
See application file for complete search history.

(56) References Cited

U.S. PATENT DOCUMENTS 9,850,716 B2 * 12/2017 Lin ..... E21B 44/005
2014/0196905 A1 * 7/2014 Schultz ..... E21B 28/00 166/319

(Continued)

FOREIGN PATENT DOCUMENTS

CN 2113332 U 8/1992
CN 201554363 U 8/2010

(Continued)

*Primary Examiner* — Shane Bomar
(74) *Attorney, Agent, or Firm* — Novick, Kim & Lee, PLLC; Allen Xue

(57) ABSTRACT

A hydraulic gentle vibration speed-enhancing drilling tool has an upper joint, a power assembly, a flow regulating valve assembly and a force transmission assembly. The upper end of an outer shell of the power assembly is in threaded connection with the upper joint of the drilling tool, at the lower end thereof, internal steps having outer octagonal structure are arranged to limit the lower joint; a middle section of the lower joint is of outer octagonal structure, with the lower end in threaded connection with an adapter; and the power assembly is of turbine set structure or screw-type mud motor structure for producing driving force under the action of hydraulic force and driving an upper rotating shaft. The upper rotating shaft is arranged on a load bearing ring, and the lower end thereof is in threaded connection with a lower rotating shaft.

6 Claims, 3 Drawing Sheets

(51) Int. Cl.

| | |
|---|---|
| ***E21B 4/00*** | (2006.01) |
| ***E21B 34/06*** | (2006.01) |
| ***E21B 28/00*** | (2006.01) |

(56) References Cited

U.S. PATENT DOCUMENTS

| | | | | |
|---|---|---|---|---|
| 2014/0246234 | A1* | 9/2014 | Gillis | E21B 7/24<br>175/24 |
| 2017/0362916 | A1* | 12/2017 | Smith | E21B 7/24 |
| 2018/0274297 | A1* | 9/2018 | Pearson | E21B 4/02 |
| 2018/0328365 | A1* | 11/2018 | Eslinger | F04D 13/086 |

FOREIGN PATENT DOCUMENTS

| | | | |
|---|---|---|---|
| CN | 201778652 | U | 3/2011 |
| CN | 105041201 | A | 11/2015 |
| CN | 103821452 | B | 1/2016 |
| JP | 2003074280 | A | 3/2003 |

* cited by examiner

A-A

B-B

HYDRAULIC GENTLE VIBRATION SPEED-ENHANCING DRILLING TOOL

FIELD OF THE TECHNOLOGY

The invention relates to a hydraulic gentle vibration speed-enhancing drilling tool for improving dynamic characteristics of a drill bit and further improving drilling speed thereof in drilling operations. The tool improves dynamic characteristics of a drill bit and further improves drilling rate thereof by applying gentle pulsating load to the drill bit at certain frequency.

BACKGROUND

A drill bit is an indispensable tool for drilling operations. Due to well bottom operating environment and drilling requirements, longitudinal and transverse vibration of a drill bit is relatively intense, especially in the case of gravel-bearing strata and deep hard strata, and premature failure of drill bits even occurs, thus reducing service life and drilling efficiency of the drill bits. However, replacement of a drill bit requires tripping operations, which will result in an increase in inefficient working hours for the entire drilling operations, which in turn increases drilling cost.

The hydraulic gentle vibration speed-enhancing drilling tool is directly mounted above a drill bit and produces gentle pulsation at certain frequency under the action of the drilling fluid, so as to improve dynamic characteristics of the drill bit and enhance working efficiency and service life of the drill bit while keeping normal weight on bit and torque transmission and avoiding obvious additional weight on bit. The invention is of great significance to promote the development of drilling speed-enhancing technology.

SUMMARY

The purpose of the invention is to improve dynamic characteristics of a drill bit, keep safe of the drill bit, improve unit drilling efficiency and service life of the drill bit, and further reduce drilling operation cost. In order to achieve the purpose, the present invention provides a hydraulic gentle vibration speed-enhancing drilling tool, and the technical solution thereof is as follows: A hydraulic gentle vibration speed-enhancing drilling tool having an upper joint (1), a power assembly, a flow regulating valve assembly and a force transmission assembly; the lower end of the upper joint (1) being in threaded connection with an outer shell (2) of the power assembly, and the upper end of the upper joint (1) being connected with other drilling tools through joint screws; the power assembly being of turbine set structure or screw-type mud motor structure for producing driving force under the action of an internal annular drilling fluid and driving an upper rotating shaft (19); the outer shell (2) achieving limitation on a load bearing ring (7) through a limit step, and a normal flow pass of load bearing ring (23) being arranged on the load bearing ring (7); step surface of the upper rotating shaft (19) being pressed against a thrust bearing 1 (8), and the thrust bearing 1 (8) being arranged on the load bearing ring (7) and fitted with a retaining ring (10), a thrust bearing 2 (11), a deep groove ball bearing (9) and a lock ring (12) to realize limit mounting of the upper rotating shaft (19); the lower end of the upper rotating shaft (19) being in threaded connection with a lower rotating shaft (14); the flow regulating valve assembly comprising a lower rotating shaft (14) and a flow regulating valve seat (15); a bypass port (24) being arranged on the lower rotating shaft (14), the flow regulating valve seat (15) being arranged on the upper end of the lower joint (16), a drainage path (21) being arranged at corresponding position of the bypass port (24), and the flow regulating valve seat (15) being also provided with a normal flow pass of flow regulating valve seat (22); and the force transmission assembly comprising a lower joint (16) and an adapter (17); the upper part of the lower joint (16) being provided with a mounting step, the middle section thereof being of outer octagonal structure and fitted with a step in the octagonal structure at the lower end of the outer shell (2), and lower end thereof being in threaded connection with the adapter (17);

when the power assembly is of turbine set driving structure, a central flow channel being arranged on the upper rotating shaft (19), and a turbine set having a turbine rotor (5) and a turbine stator (6) being arranged on the upper part and being pressed against the upper rotating shaft (19) through a rotor head (4); the turbine stator (5) being pressed against the load bearing ring (7) under the action of a compression ring (3) and the upper joint (1); a central flow path being arranged on the lower rotating shaft (14) and forming a drilling fluid central flow path together with the central flow path of the upper rotating shaft (19), the bypass port (24) and the drainage path (21); and a pore plug (13) being used to block the tool position hole formed when machining the drainage path (21);

when the power assembly is of screw-type mud motor driving structure, the outer shell (2) having an upper section of the outer shell (2(1)) and a lower section of the outer shell (2(2)); a screw stator (28) being fixedly arranged on the inner wall of the upper section (2(1)) of the outer shell, and a screw rotor (27) being arranged in the screw stator (28); the screw rotor (27) being in threaded connection with the upper end of an universal joint (26), and a lower end of the universal joint (26) being in threaded connection with the upper rotating shaft (19); and the upper section of the outer shell (2(1)) being in threaded connection with the lower section of the outer shell (2 (2)), and a thin-walled compression ring (25) being pressed against the load bearing ring (7) under the action of the upper section of the outer shell (2(1)).

Compared with the prior art, the invention has the following beneficial effects: (1) the pressure drop produced by the tool is too small to significantly reduce hydraulic action energy at the bottom, and bottom cleaning capacity of the drilling fluid is ensured; (2) the resulting pulsating load is too moderate to produce a significant additional effect on weight on bit; (3) the tool makes weight on bit and torque smoothly transmitted to the drill bit without energy transfer loss; (4) the tool effectively improves dynamic characteristics of the drill bit, thereby protecting the drill bit and prolonging the service life thereof; and (5) due to simple structure, easy maintenance and manufacturing, and low cost of the tool, drilling speed can increase without significantly increasing investment and changing existing drilling technology.

In the figures: 1 upper joint; 2 outer shell; 2(1) upper section of outer shell; 2(2) lower section of outer shell; 3 compression ring; 4 rotor head; 5 turbine stator; 6 turbine rotor; 7 load bearing ring; 8 thrust bearing 1; 9 deep groove ball bearing; 10 retaining ring; 11 thrust bearing 2; 12 lock ring; 13 pore plug; 14 lower rotating shaft; 15 flow regulating valve seat; 16 lower joint; 17 adapter; 18 upper rotating shaft mounting hole; 19 upper rotating shaft; 20 rotor head mounting hole; 21 drainage path; 22 normal flow path of flow regulating valve seat; 23 normal flow path of load bearing ring; 24 bypass port; 25 thin-walled compression ring; 26 universal joint; 27 screw rotor; 28 screw stator.

DESCRIPTION OF THE PREFERRED EMBODIMENT

Figure 1:
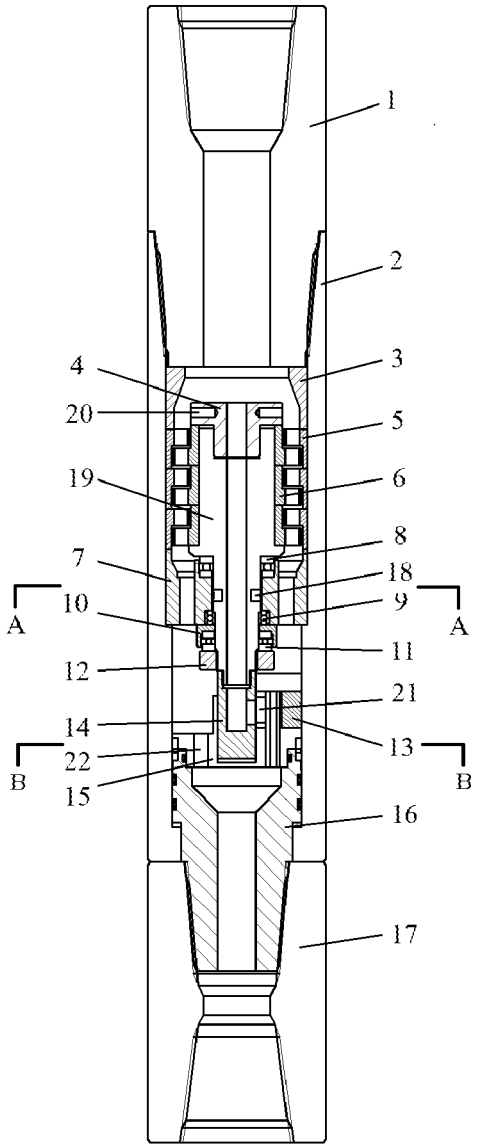
FIG. 1 is a structural diagram of the hydraulic gentle vibration speed-enhancing drilling tool having the turbine set driving structure.
Figure 2:
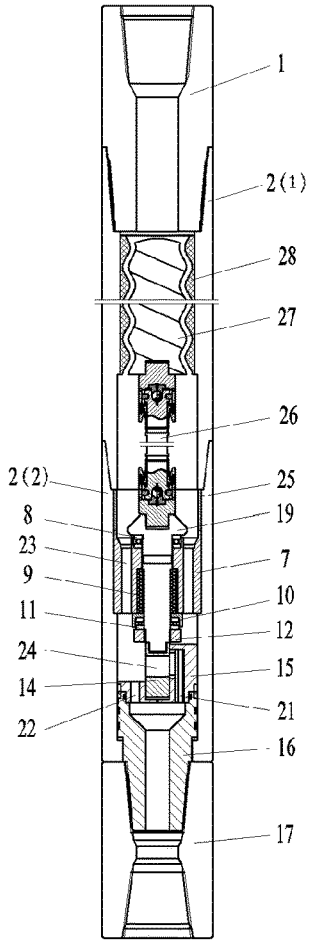
FIG. 2 is a structural diagram of the hydraulic gentle vibration speed-enhancing drilling tool having the screw-type mud motor driving structure.
Figure 3:
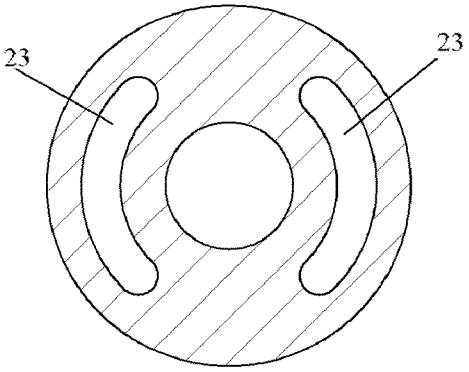
FIG. 3 is a cross section diagram of the load bearing ring of the hydraulic gentle vibration speed-enhancing drilling tool obtained from section A-A.
Figure 4:
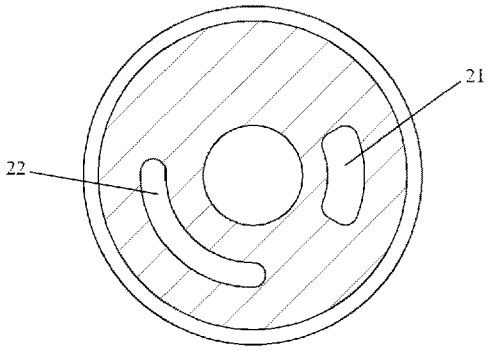
FIG. 4 is a cross section diagram of the flow regulating valve seat of the hydraulic gentle vibration speed-enhancing drilling tool obtained from section B-B.
Figure 5:
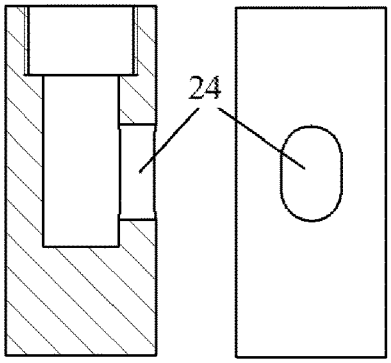
FIG. 5 is a structural diagram of the lower rotating shaft when the hydraulic gentle vibration speed-enhancing drilling tool of the invention has the turbine set driving structure.
Figure 6:
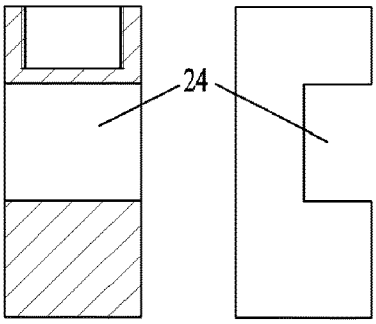
FIG. 6 is a structural diagram of the lower rotating shaft when the hydraulic gentle vibration speed-enhancing drilling tool of the invention has the screw-type mud motor driving structure.

As shown in FIG. 1, the hydraulic gentle vibration speed-enhancing drilling tool according to the invention has an upper joint (1), a power assembly, a flow regulating valve assembly and a force transmission assembly. The lower end of the upper joint (1) is in threaded connection with an outer shell (2) of the power assembly, and the upper end of the upper joint (1) being connected with other drilling tools through joint screws; the power assembly being of turbine set structure or screw-type mud motor structure for producing driving force under the action of an internal annular drilling fluid and driving an upper rotating shaft (19); the outer shell (2) achieving limitation on a load bearing ring (7) through a limit step, and a normal flow pass of load bearing ring (23) being arranged on the load bearing ring (7); step surface of the upper rotating shaft (19) being pressed against a thrust bearing 1 (8), and the thrust bearing 1 (8) being arranged on the load bearing ring (7) and fitted with a retaining ring (10), a thrust bearing 2 (11), a deep groove ball bearing (9) and a lock ring (12) to realize limit mounting of the upper rotating shaft (19); the lower end of the upper rotating shaft (19) being in threaded connection with a lower rotating shaft (14); the flow regulating valve assembly having a lower rotating shaft (14) and a flow regulating valve seat (15); a bypass port (24) being arranged on the lower rotating shaft (14), the flow regulating valve seat (15) being arranged on the upper end of the lower joint (16), a drainage path (21) being arranged at corresponding position of the bypass port (24), and the flow regulating valve seat (15) being also provided with a normal flow pass of flow regulating valve seat (22); and the force transmission assembly comprising a lower joint (16) and an adapter (17); the upper part of the lower joint (16) being provided with a mounting step, the middle section thereof being of outer octagonal structure and fitted with a step in the octagonal structure at the lower end of the outer shell (2), and lower end thereof being in threaded connection with the adapter (17);

when the power assembly is of turbine set driving structure, a central flow channel being arranged on the upper rotating shaft (19), and a turbine set having a turbine stator (5) and a turbine rotor (6) being arranged on the upper part and being pressed against the upper rotating shaft (19) through a rotor head (4); the turbine stator (5) being pressed against the load bearing ring (7) under the action of a compression ring (3) and the upper joint (1); a central flow path being arranged on the lower rotating shaft (14) and forming a drilling fluid central flow path together with the central flow path of the upper rotating shaft (19), the bypass port (24) and the drainage path (21); and a pore plug (13) being used to block the tool position hole formed when machining the drainage path (21);

when the power assembly is of screw-type mud motor driving structure, the outer shell (2) having an upper section of the outer shell (2(1)) and a lower section of the outer shell (2(2)); a screw stator (28) being fixedly arranged on the inner wall of the upper section (2(1)) of the outer shell, and a screw rotor (27) being arranged in the screw stator (28); the screw rotor (27) being in threaded connection with the upper end of an universal joint (26), and a lower end of the universal joint (26) being in threaded connection with the upper rotating shaft (19); and the upper section of the outer shell (2(1)) being in threaded connection with the lower section of the outer shell (2 (2)), and a thin-walled compression ring (25) being pressed against the load bearing ring (7) under the action of the upper section of the outer shell (2(1)).

In use, the tool is arranged directly above the drill bit, and a hook load is adjusted to apply a predetermined weight on bit to the drill bit. At the moment, the lower end face of the outer shell (2) is pressed against the upper end face of the adapter (17), and the gap between the mounting step at the upper part of the lower joint (16) and the upper end face of the step in the octagonal hole structure at the lower end of the outer shell (2) is maximum. An internal annular drilling fluid flows through the power assembly and drives the upper rotating shaft (19) and the lower rotating shaft (14) to rotate. When a gap forms in the communicated drilling fluid central flow path or between the bypass port (24) and drainage path (21), part of the drilling fluid flows through the flow regulating valve seat (15) via the drainage path (21) for diverting the drilling fluid. Then, area of passage increases and pressure of the drilling fluid in the tool cavity decreases. When the drilling fluid central flow path is cut off or the gap between the bypass port (24) and drainage path (21) disappears after the lower rotating shaft (14) rotates at an angle so that the bypass port (24) and drainage path (21) are misaligned relatively, due to the loss of drilling fluid diverting action, area of passage of the drilling fluid reduces, resulting in increase in the drilling fluid pressure in the tool cavity and increase in acting force of the drilling fluid on the flow regulating valve seat (15). However, the whole process takes place in a short time and produces an acting force with certain amplitude value that is then transferred to the adapter (17) through the lower joint (16) and to the drill bit successively. With continuous rotation of the lower rotating shaft (14), the above process is repeated to form an acting force having a certain frequency.

When a turbine set having a turbine rotor (6) and a turbine stator (5) is mounted, a cylindrical steel rod with a diameter of 10 mm is inserted into the upper rotating shaft mounting hole (18) and the rotor head mounting hole (20) to generate an arm of force, and the rotor head (4) is rotated to press the turbine rotor (6) against the upper rotating shaft (19.

What is claimed is:

1. A hydraulic vibration speed-enhancing drilling tool, comprising: an upper joint, a power assembly, a flow regulating valve assembly, and a force transmission assembly, wherein a lower end of the upper joint is in a threaded connection with an outer shell of the power assembly, wherein the power assembly drives an upper rotating shaft, wherein the outer shell comprises a limiting step that limits a position of a load bearing ring, wherein the load bearing ring comprises a first normal-open channel for passing a drilling fluid during operation, wherein the upper rotating shaft comprises a step that presses against a first thrust bearing arranged on the load bearing ring, wherein the first thrust bearing, a retaining ring, a second thrust bearing, a ball bearing, and a lock ring realize limit mounting of the upper rotating shaft, wherein a lower end of the upper rotating shaft is in a threaded connection with a lower rotating shaft, wherein the flow regulating valve assembly comprises the lower rotating shaft and a flow regulating valve seat, wherein a bypass port is arranged on the lower rotating shaft, and the flow regulating valve seat is arranged on the upper end of the lower joint, a drainage path is arranged at corresponding position of the bypass port, and the flow regulating valve seat comprises a second normal-open channel for passing the drilling fluid during operation, and wherein the force transmission assembly comprises the lower joint and an adapter, wherein the lower joint has a mounting step in an upper section, an octagonal middle section fitted with a step in a corresponding octagonal structure at a lower end of the outer shell, and a lower section in a threaded connection with the adapter.

2. The hydraulic vibration speed-enhancing drilling tool according to claim 1, further comprising a gap of less than 10 mm between a mounting step surface at the upper part of the lower joint and an upper end face of a step in the octagonal structure at the lower end of the outer shell, and the lower joint and the flow regulating valve seat are axially slidable within a distance of the gap.

3. The hydraulic vibration speed-enhancing drilling tool according to claim 1, wherein the power assembly comprises a turbine drilling motor having a turbine rotor and a turbine stator, wherein the turbine drilling motor is affixed to the upper rotating shaft through a rotor head, the turbine stator is pressed against the load bearing ring under the action of a compression ring and the upper joint, and a central flow path extends through the upper rotating shaft and the lower rotating shaft on the lower rotating shaft.

4. The hydraulic vibration speed-enhancing drilling tool according to claim 1, wherein the power assembly comprises a screw-type mud motor comprising a rotor and a stator, wherein the rotor is disposed inside the stator and is in a threaded connected with an upper end of a universal joint, and a lower end of the universal joint is in a threaded connect with the upper rotating shaft, wherein the outer shell comprises an upper section and a lower section in a threaded connection with each other, and wherein a thin-wall compression ring is pressed against the load bearing ring under the action of the upper section of the outer shell.

5. The hydraulic vibration speed-enhancing drilling tool according to claim 3, wherein the bypass port is a circular combination port, and, during operation, the drilling fluid flows through the turbine drilling motor and drives the lower rotating shaft and the flow regulating valve seat to rotate oppositely; and, when the bypass port on the lower rotating shaft is aligned with the drainage path, the drilling fluid central flow path forms a passage for diverting the drilling fluid flowing through the flow adjusting valve seat, and when the bypass port rotates at an angle relative to the drainage path, the drilling fluid central flow path is blocked.

6. The hydraulic vibration speed-enhancing drilling tool according to claim 4, wherein the bypass port is a rectangular through hole, and, during operation, when the bypass port on the lower rotating shaft rotates to align with the drainage path, a portion of a drilling fluid flows through the flow adjusting valve seat from the drainage path via a gap formed between the bypass port and the drainage path for diverting the drilling fluid.

* * * * *